United States Patent [19]

Carboni

[11] Patent Number: 4,947,768

[45] Date of Patent: Aug. 14, 1990

[54] SMOKE PURIFIER APPARATUS FOR CHIMNEYS

[75] Inventor: Luigi Carboni, Via Argentero 2, I-10126 Torino, Italy

[73] Assignees: Luigi Carboni; Luciano Bonansea, both of Turin, Italy

[21] Appl. No.: 348,027

[22] Filed: May 5, 1989

[51] Int. Cl.[5] ..... F23B 5/00; F23C 9/00; F23G 7/06

[52] U.S. Cl. ..... 110/214; 110/216; 422/174; 422/177; 431/202

[58] Field of Search ..... 110/211, 214, 215, 216; 431/5, 202; 422/174, 177

[56] References Cited

U.S. PATENT DOCUMENTS

| | | | |
|---|---|---|---|
| 3,460,916 | 8/1969 | Aronsohn | 431/202 X |
| 4,021,189 | 5/1977 | Swann et al. | 431/202 |
| 4,336,017 | 6/1982 | Desty | 431/202 |

FOREIGN PATENT DOCUMENTS

| | | |
|---|---|---|
| 1159607 | 9/1983 | Italy . |
| 1184021 | 12/1985 | Italy . |

*Primary Examiner*—Edward G. Favors

*Attorney, Agent, or Firm*—Young & Thompson

[57] ABSTRACT

A smoke purifier apparatus for chimneys and the like, comprising an intake, a suction chamber for additional air, a combustion chamber located downstream of the intake and the suction chamber, an igniter member arranged within the combustion chamber and including a thermic element heated to a high temperature, and an outlet connection extending downstream of the combustion chamber, wherein the intake and the combustion chamber are so shaped as to form in their whole a venturi tube whose throat section is located at the transition between the intake and the combustion chamber, and the air suction chamber is located in the intake center, it communicates with the surrounding ambient through ducts traversing the intake, and it leads to the throat section of the venturi tube formed by the intake and the combustion chamber. The igniter arranged within the combustion is formed by a body of quartz, which is transparent to the thermic radiations emitted by the included thermic element, and this latter is so designed and supplied as to be heated to a temperature at which it emits a thermic radiation accompanied by a light radiation in the field of the cherry red color.

10 Claims, 2 Drawing Sheets

SMOKE PURIFIER APPARATUS FOR CHIMNEYS

BACKGROUND OF THE INVENTION

This invention relates to a smoke purifier apparatus for chimneys and the like, having an intake, a suction chamber for additional air, a combustion chamber located downstream of said intake and said suction chamber, an igniter member arranged within said combustion chamber and including a thermic element heated to a high temperature, and an outlet connection extending downstream of said combustion chamber.

It is known that both the civil and the industrial chimneys deliver smokes wherein, along with ash and other solid residual combustion products, there are contained some substances (such as carbon monoxide, unburnt hydrocarbons and nitrogen oxides) which result from an incomplete combustion, and some substances (such as sulphur dioxide) which result from the combustion of impurities contained in the fuel material by which the smokes are produced. All these substances heavily contribute to the ambient pollution and to the soiling of the discharge ducts of the chimneys. Moreover some of these substances, such as nitrogen oxides and sulphur dioxide, by combining with water produce highly corrosive acids. Therefore it is required that the smokes delivered by the civil and industrial chimneys are depurated, both in order to separate the solid residual substances carried by them, and in order to chemically modify at least the more polluting substances contained therein.

To this purpose some apparatuses have been proposed, such as electrostatic separators, liquid flow separators, filters, cyclones, gas supplied afterburners and catalytic afterburners. However, in most cases the installation and management costs of such purifier apparatuses are unsustainable, whilst on the other hand their effectiveness is not satisfactory in the general applications.

The Italian Patent No. 1,159,607 proposes a purifier apparatus for chimney smokes, with an intake for smokes, an annular suction chamber for additional air surrounding the intake, a fan acting onto the whole cross section of both the intake and the annular air suction chamber, a combustion chamber extending downstream of said fan, an igniter member arranged within the combustion chamber and including a thermic element heated to a high temperature, filter means located at the outlet of the combustion chamber, and means for collecting the solid residual substances separated by the filter means. In this apparatus, the passages for smoke and for additional air join one another upstream of the fan, and the igniter member is formed by a reflecting hollow member of stainless steel which concentrates internally of itself the heat radiating from the included thermic element. By the Italian Patent No. 1,184,021 this apparatus has been improved, particularly with respect to the fan means.

Such improved apparatuses are considerably progressive with respect to the former state of art, and they ensure a satisfactory operation in normal conditions. However they still have some disadvantages which are revealed mainly at start and in transient operation conditions, due to the inertia of the fan means. These latter, if they are not driven by a motor but only by the gas flow, start operating or accelerate with some delay before actuating an effective air suction. Therefore some smoke reflux through the air suction chamber can sometimes take place.

BRIEF SUMMARY OF THE INVENTION

The main object of this invention is to radically overcome the stated disadvantages of the known apparatuses by allowing obtaining an effective additional air suction even in the absence of any fan means, whereby any disadvantage caused by inertia is avoided. Another object of the invention is to provide an apparatus which is of substantially simple and relatively inexpensive construction. A further object of the invention is to provide such an apparatus in which an optimal operation is ensured in any operating condition, either permanent or transient.

In an apparatus as defined in the preamble, this object is attained, according to the invention, mainly in that the intake and the combustion chamber are so shaped as to form in their whole a venturi tube whose throat section is located at the transition between said two parts, and the air suction chamber is located in the intake center, it communicates with the surrounding ambient through ducts traversing the intake, and it leads to the throat section of the venturi tube formed by the intake and the combustion chamber.

Due to these features, both flows entering the apparatus, the smoke flow and the additional air flow, are positively separated until they join at the throat section of the venturi tube formed by the intake and the combustion chamber. In this region a reduced pressure is generated by the aerodynamic effect of the smoke flow in the venturi tube, and this prevents, in all operating conditions, any smoke reflux through the air suction chamber. The central arrangement of this latter within the smoke intake ensures an optimal effect of the suction of the venturi tube. This suction, not being obtained by mechanical means, shows no inertia at start nor in the transient periods, and in any event it spontaneously conforms to the present smoke flow rate.

Preferably, the igniter arranged within the combustion chamber is formed by at least one body which is transparent to the thermic radiations emitted by the included thermic element, and this latter is so designed and supplied as to be heated to a temperature at which it emits a thermic radiation accompanied by a light radiation in the field of the cherry red color.

The transparency of the igniter member allows the radiations emitted by the thermic member to extend to and operate onto the whole space of the combustion chamber surrounding the igniter member. Thanks to the particular selection of a temperature of the thermic element corresponding to the emission of a light radiation in the field of the cherry red color, a maximum photochemical effect is obtained, thus favoring oxidization of the unburnt substances contained in the smoke by action of the oxygen contained both in the smoke itself and in the sucked additional air. Therefore the apparatus of the invention may be effective in all operating conditions.

BRIEF DESCRIPTION OF THE DRAWINGS

These and other features and advantages of the subject of the invention will appear more clearly from the following description of an embodiment, having an exemplary and not limiting character, diagrammatically shown in cross section, on a reduced scale, in the accompanying drawings, wherein.

DETAILED DESCRIPTION OF THE PREFERRED EMBODIMENT

Figure 2:
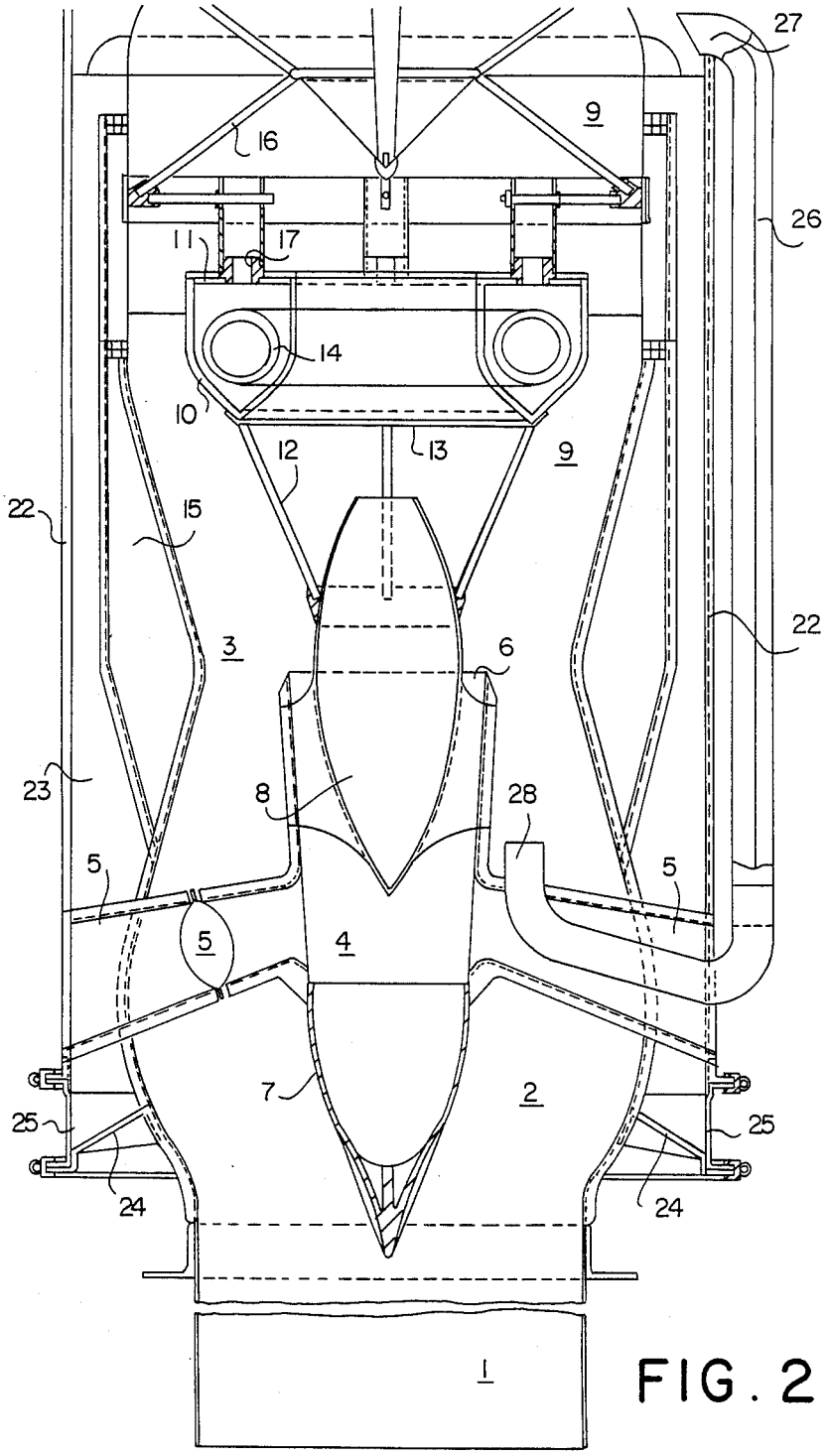
FIG. 2 shows the bottom portion thereof; the FIGS. 1 and 2 being intended as jointed to one another with some superposition.

In the drawings, with reference to FIG. 2, number 1 designates an intake intended to be connected and fixed to the outlet end of a chimney or any other duct for discharge of smoke, in order to receive the smokes therefrom and to forward the same to the operating parts of the apparatus. Intake 1 is extended by a portion 2 whose passage cross section gradually decreases up to a throat section 3, where the smoke intake 1 ends. A chamber 4 for air suction is centrally mounted within the smoke intake 1. The air suction chamber 4 communicates with the surrounding ambient by means of ducts 5 (whose cross section is shown in the left hand part of FIG. 2), and it ends by means of an outlet 6 registering with the throat section 3 of the smoke intake 1. The air suction chamber 4 is closed by a bottom ogive 7. Due to the presence of the ogive 7, the smokes entering the intake 1 are not hindered by the presence of the air suction chamber 4. It is of advantage that the ogive 7 is made of a catalytically active material in order to effect a first chemical modification of the smokes lapping the ogive. More particularly, the ogive 7 may be made of a brass casting containing a high fraction of copper and silicon alloy, whereby it is particularly effective on the nitrogen oxides contained in the smokes. A second ogive 8 is provided at the outlet 6 of the air suction chamber 4 in order to facilitate the flow of additional air.

The combustion chamber 9 starts from the throat end 3 of the smoke intake 1. In the combustion chamber 9 join together the smoke flow from intake 1–2 and the additional air flow from the air suction chamber 4. The inner cross section of the combustion chamber 9 gradually increases from the starting throat section, and therefore the whole of intake 1–2 and chamber 9 forms a venturi tube, in whose throat section 3 joins the air suction chamber 4. As is well known, the aerodynamic effect of a flow passing through such a tube generates in the throat section an underpressure. This underpressure causes the suction of additional air through chamber 4, without need for any movable mechanical member.

In the combustion chamber 9 there is mounted an igniter member 10, which is formed by a toroidal cup of a material resistant to high temperatures and transparent to thermic radiations. A material particularly suitable for this use is quartz. The igniter member 10 is closed at top by an annular cover 11 of the same material. The igniter member 10 is supported by a framing 12 connected to the ogive 8 and ending by a plate 13 on which rests the igniter member 10. Preferably an insulating packing, for example of asbestos, is interposed between the igniter member 10 and the plate 13. The space inside framing 12 is preferably filled with copper wool, which acts catalytically on the mixture of smoke and additional air.

Inside the igniter member 10 there is mounted an ironclad electric resistance 14, which is designed and electrically supplied in order to attain a temperature corresponding to the emission of light in the field of the cherry red color. It has turned out, in effect, that this radiation gives rise to the maximum photochemical effect on the surrounding smokes, also effectively cooperating on the afterburning. The afterburning action, mainly due to the oxygen contained in the additional air sucked, applies to the unburnt gases and particularly to the carbon monoxide, the carbon residues and the unburnt hydrocarbons. The radiation emitted by the resistance 14 extends to the whole space of the combustion chamber 9, due to the igniter member 10 being made of a material which is transparent to this radiation. Due to the afterburning, a relatively high temperature is established in the combustion chamber 9, and therefore it is suitable that the walls of chamber 9 are covered by an insulating material 15. The walls of the combustion chamber 9 are preferably manufactured of stainless steel. This latter, due to the nickel and chromium contained therein, effects a useful catalytic action on the smokes.

Figure 1:
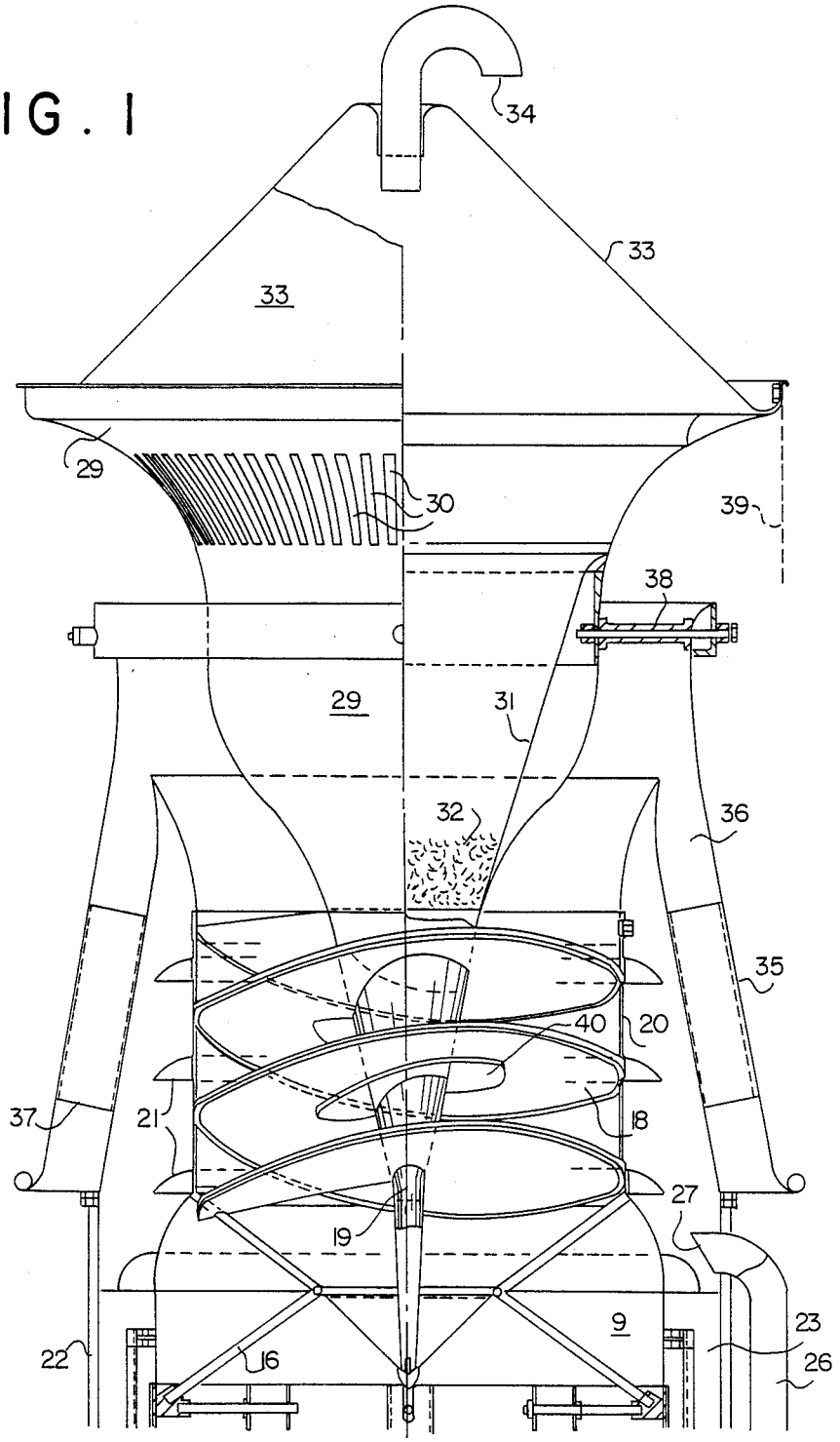
FIG. 1 shows the top portion of the apparatus according to the invention.

Above the igniter member 10 extends a framing 16, whose bottom part keeps in position, by means of insulating members 17, the cover 11 of the igniter member, and whose top part supports the purifier means 18, shown in FIG. 1 of the drawings.

The purifier means 18 comprise a network of catalytically active material. The network 18 is shaped like a helicoid and it is located between an inner supporting cone 19 and a peripheral wall 20. The network 18 may advantageously be formed by or covered with tantalum or another element having catalytic action, such as for example iridium or indium, and it is of advantage that it forms a double layer. Preferably the helicoidally shaped network 18 is accompanied by a parallel helicoidal body 40 of copper, extending from the central cone 19. These helicoidal bodies, apart from operating catalytically onto the lapping gases, impart to them a rotary movement. Due to this rotary movement, the gases are subjected to centrifugal forces which displace the solid residual substances towards the peripheral wall 20. This latter is apertured and is provided with deflectors 21, which cause the solid residual substances to fall downwards outside the peripheral wall 20. The wall 20, as well as the underlying apparatus parts formerly described, are surrounded by an outer casing 22. The casing 22 defines an annular collecting chamber 23, wherein collect the residual solid substances thus separated from the smokes. Chamber 23 ends at bottom with an inclined base 24. Some peripheral removable hatches 25 are provided in order to allow periodical removal of the solid residual substances collected in chamber 23. A pipe 26 is connected at 27 to the top portion of the collecting chamber 23 and opens at the opposite end 28 into the intake 2, near its throat section 3. By this arrangement there is prevented in the collecting chamber 23 any accidental overpressure, which could hinder entrance of the solid residual substances in the collecting chamber. The pipe 26 is shown, for the need of drawing, in the plane of the shown section, but of course it may be located in any position, and it does not need to pass along a duct 5 for entry of additional air.

The upper part of cone 19 expands at 29 to cover the apparatus outlet, in order to prevent entrance therein of atmospheric precipitations. Preferably, some slots 30 are provided, in order to allow that solid residual substances, possibly still contained in the smokes, pass inside the expanded part 29 of cone 19, where a removable collecting basket 31 is housed for receiving the solid residual substances 32. The chamber which houses said basket is covered by a removable cover forming a roof 33 having a vent tube 34.

It is of advantage that an outer wall defines an annular passage 36 for air convection around the upper outlet of the apparatus. Thereby the delivered smokes suck some air and are diluted and cooled before entering the atmosphere. The outer wall 35 is supported by radial spacers 37 and 38. When needed, a network 39 may be connected to member 29 by hanging therefrom, and located around the smoke outlet of the apparatus, in order to positively prevent any entrance therein of atmospheric precipitations.

Of course some changes may be made to what has been described and shown, in order that the apparatus is made suitable for different practical requirements, particularly in connection with different rates of flow of the treated smokes, different smoke compositions and different draft conditions. For example, the ironclad resistance 14 could be replaced by another kind of electrically supplied heat generator, such as a helicoidal resistance or an induction heated element. Different shapes may be chosen for the igniter member. Several igniter members could be mounted within the combustion chamber, suitably spaced therein. The arrangement of the catalytic active members may also be modified, further catalytic elements could be added or some of them may be suppressed.

I claim:

1. A smoke purifier apparatus for chimneys and the like, comprising an intake, a suction chamber for additional air located in the intake center, ducts traversing said intake communicating said suction chamber with the surrounding ambient, a combustion chamber located downstream of said intake and said suction chamber, an igniter member arranged within said combustion chamber and including a thermic element heated to a high temperature, and an outlet connection extending downstream of said combustion chamber, said intake and combustion chamber being so shaped as to form in their whole a venturi tube having a throat section located a the transition between said intake and combustion chamber, and said air suction chamber opening in said throat section of the venturi tube formed by the intake and the combustion chamber, whereby suction of additional air takes place due to the venturi effect, without need for additional mechanical suction means.

2. A smoke purifier apparatus for chimneys, as set forth in claim 1, wherein said igniter member arranged within said combustion chamber comprises at least one body which is transparent to the thermic radiations emitted by said included thermic element, and said thermic element is so designed and supplied as to be heated to a temperature at which it emits a thermic radiation accompanied by a light radiation in the field of the cherry red color.

3. A smoke purifier apparatus for chimneys, as set forth in claim 1, wherein said additional air suction chamber has a part shaped as an ogive, said ogive facing said intake for the smokes and being made of a material having a catalytic effect.

4. A smoke purifier apparatus for chimneys, as set forth in claim 1, wherein said additional air suction chamber has at its outlet an ogive member, and further comprising a framing connected to said ogive member in order to support said igniter member.

5. A smoke purifier apparatus for chimneys, as set forth in claim 1, wherein said igniter member comprises a toroidal cup made of a material resistant to heat and transparent for the thermic radiations emitted by said thermic element, said toroidal cup being preferably made of quartz.

6. A smoke purifier apparatus for chimneys, as set forth in claim 1, wherein said combustion chamber comprises walls made of or covered with a material having catalytic action, and a thermically insulating material surrounding said walls.

7. A smoke purifier apparatus for chimneys, as set forth in claim 1, further comprising a catalytic purifier arranged downstream said combustion chamber, said catalytic purifier comprising a central supporting member, a peripheral wall and a network shaped as a helicoid, preferably forming a double layer, mounted between said central supporting member and said peripheral wall; and further comprising a collecting chamber surrounding said catalytic purifier; said peripheral wall having apertures communicating with said collecting chamber.

8. A smoke purifier apparatus for chimneys, as set forth in claim 7, wherein said collecting chamber has discharge hatches, and it has a pipe ending within said intake for the smokes, in order to prevent any overpressure in said collecting chamber.

9. A smoke purifier apparatus for chimneys, as set forth in claim 7, wherein said helicoidal network is made of or covered with tantalum or a similar catalytic element, and further comprising a copper member shaped as a helicoid, substantially parallel to said helicoidal network.

10. A smoke purifier apparatus for chimneys, as set forth in claim 7, further comprising a covering member located downstream said catalytic purifier, a removable collecting basket mounted within said covering member, a roof superimposed to said covering member and a vent tube traversing said roof.

* * * * *